US008739466B2

(12) United States Patent
Kristerson

(10) Patent No.: US 8,739,466 B2
(45) Date of Patent: Jun. 3, 2014

(54) EMERGENCY OPENING SYSTEM FOR VEHICLE DOOR OR WINDOW

(75) Inventor: Mats Kristerson, Vollsjö (SE)

(73) Assignee: Durban AB, Malmö (SE)

( * ) Notice: Subject to any disclaimer, the term of this patent is extended or adjusted under 35 U.S.C. 154(b) by 113 days.

(21) Appl. No.: 13/381,609

(22) PCT Filed: Jun. 30, 2010

(86) PCT No.: PCT/EP2010/059309

§ 371 (c)(1),
(2), (4) Date: May 9, 2012

(87) PCT Pub. No.: WO2011/000884

PCT Pub. Date: Jan. 6, 2011

(65) Prior Publication Data

US 2012/0227324 A1 Sep. 13, 2012

(30) Foreign Application Priority Data

Jun. 30, 2009 (SE) ..... 0950510

(51) Int. Cl.
*E05F 15/02* (2006.01)
*E05C 1/12* (2006.01)
*E05B 65/12* (2006.01)

(52) U.S. Cl.
USPC ..... 49/141; 49/502

(58) Field of Classification Search
USPC ..... 49/141, 502; 296/190.11, 187.03, 296/187.12, 187.07, 146.4, 146.5, 146.6, 296/146.9, 1.04; 292/92, 93, 201, 216, 292/DIG. 23, DIG. 65
See application file for complete search history.

(56) References Cited

U.S. PATENT DOCUMENTS

| | | | | |
|---|---|---|---|---|
| 2,922,672 | A | 1/1960 | Voorhees | |
| 2,958,089 | A * | 11/1960 | Roehm et al. | 16/49 |
| 4,094,158 | A * | 6/1978 | LeVere et al. | 405/303 |
| 4,183,177 | A * | 1/1980 | Kurdziel | 49/25 |
| 4,235,047 | A * | 11/1980 | Turner | 49/371 |
| 4,263,853 | A * | 4/1981 | Robertson | 105/378 |
| 5,381,628 | A * | 1/1995 | D'Hooge | 49/394 |
| 7,690,153 | B2 * | 4/2010 | Pelz | 49/141 |
| 7,865,999 | B2 * | 1/2011 | Hilger | 16/65 |
| 8,171,673 | B2 * | 5/2012 | Helms | 49/341 |
| 2006/0010769 | A1 * | 1/2006 | Pelz | 49/141 |
| 2007/0265753 | A1 | 11/2007 | Cantu | |
| 2008/0229666 | A1 * | 9/2008 | Jones | 49/334 |
| 2009/0120002 | A1 * | 5/2009 | Domholt | 49/340 |

FOREIGN PATENT DOCUMENTS

| | | |
|---|---|---|
| DE | 1505712 | 7/1970 |
| DE | 3536648 | 4/1987 |
| DE | 2000899 | 5/2000 |
| GB | 2261916 | 6/1993 |

* cited by examiner

*Primary Examiner* — Katherine Mitchell
*Assistant Examiner* — Justin Rephann
(74) *Attorney, Agent, or Firm* — Lowe Graham Jones PLLC

(57) ABSTRACT

A system for emergency opening of a door or window of a vehicle comprises an opening mechanism for forcing the door or window to open by means of pressure of hydraulic fluid, and an unlocking mechanism, which by means of hydraulic fluid is configured to unlock a lock of the door or window. The system may be connected to the brake system of a vehicle.

13 Claims, 8 Drawing Sheets

EMERGENCY OPENING SYSTEM FOR VEHICLE DOOR OR WINDOW

PRIORITY CLAIM

This invention claims priority from PCT Application Serial No. PCT/EP2010/059309 filed Jun. 30, 2010, which claims priority to Swedish Application Serial No. 0950510-8 filed Jun. 30, 2009, which is hereby incorporated by reference.

TECHNICAL FIELD

This invention pertains in general to the field of emergency opening systems. More particularly the invention concerns a system enabling emergency opening of a door and/or window of a vehicle, and even more particularly to an emergency opening system for an armored vehicle.

BACKGROUND

In the case of an emergency, such as a fire, it is of great importance to be able to open a normally locked door and/or window in order for a person to escape the dangerous area.

Another situation in which emergency opening of a door or window is desired is in the event that a vehicle, such a splinter protected or armored vehicle, has been turned over, e.g. due to a land mine explosion. In this case the doors or windows, which normally are openable, may be impossible to open by hand, either due to the heavy weight of the doors or windows or due to the deformation of the door or window in result of the explosion.

In the event that the vehicle is turned over by a land mine explosion, it is likely that the driver of the vehicle and the vehicle personnel are turned unconscious, while the risk of vehicle fire is imminent.

In such an event, it is required that a number of people equipped with crowbars or similar is available in order to break open the door or window from outside the vehicle.

In order to facilitate opening the door or window from the outside, some vehicles are provided with a functionality of opening a door or window from the outside in case of emergency. However, there have been incidences with angry mobs which have used the outside emergency opening functionality to pull out the vehicle personnel in rage, leading to severe personnel injuries.

Hence, an improved emergency opening system would be advantageous.

SUMMARY

Accordingly, the present invention preferably seeks to mitigate, alleviate or eliminate one or more of the above-identified deficiencies in the art and disadvantages singly or in any combination and solves at least the above mentioned problems by providing a system for emergency opening of a door, window, or the like in a vehicle, as well as a method and use having the features defined in the appended independent claims.

An object of the present invention is to provide an emergency opening system of a door and/or window of a vehicle, in case of emergency.

According to an aspect of the invention, a system for emergency opening of a door, window or the like in a vehicle is provided. The system comprises an unlocking mechanism configured to open a lock provided on the door or window by means of the pressure of hydraulic fluid, when activated.

In another aspect of the invention a vehicle comprising the emergency opening system is provided.

According to yet another aspect of the invention, a method for restoring the emergency opening system after activation comprises: (a) setting a restoration valve provided on the inside of the vehicle into its open position, while an opening valve and a blocking valve provided on the inside of the vehicle are closed, to drain the emergency opening system of hydraulic fluid and enable hydraulic cylinders of the opening mechanism and unlocking mechanism to be repositioned to their idle positions; and (b) setting the restoration valve into its closed position to block hydraulic fluid from exiting the emergency opening system.

In yet another aspect of the invention, a use of the emergency opening system for emergency opening of a door or window of a vehicle is provided.

Preferred embodiments of the invention are set forth in the appended dependent claims.

An advantage of the system according to some embodiments of the invention is that it enables emergency opening of a door or window of a vehicle, from the inside of the vehicle in all situations and from the outside when this functionality is activated.

Another advantage of the system according to some embodiments of the invention is that it allows for a simple structure, thereby providing compactness and robustness. Due to the robustness, the system according to some embodiments may still function correctly after a land mine explosion.

Still another advantage of the system according to some embodiments is that the energy required for opening the door and/or window, in case of emergency, is collected from the brake system of the vehicle, without affecting the brake function or the roll over protection system (ROPS) of the vehicle.

BRIEF DESCRIPTION OF THE DRAWINGS

These and other aspects, features and advantages of which the invention is capable of will be apparent and elucidated from the following description of non-limiting embodiments given as examples, reference being made to the accompanying drawings, in which.

DESCRIPTION OF EMBODIMENT

The following description focuses on embodiments of the present invention applicable to an emergency opening system, and in particular to an emergency opening system for opening a door and/or window of a vehicle, in case of emergency. However, it will be appreciated that the emergency opening system is not applicable only to vehicle applications but may be applied to all structures where emergency opening is desired.

Figure 1:
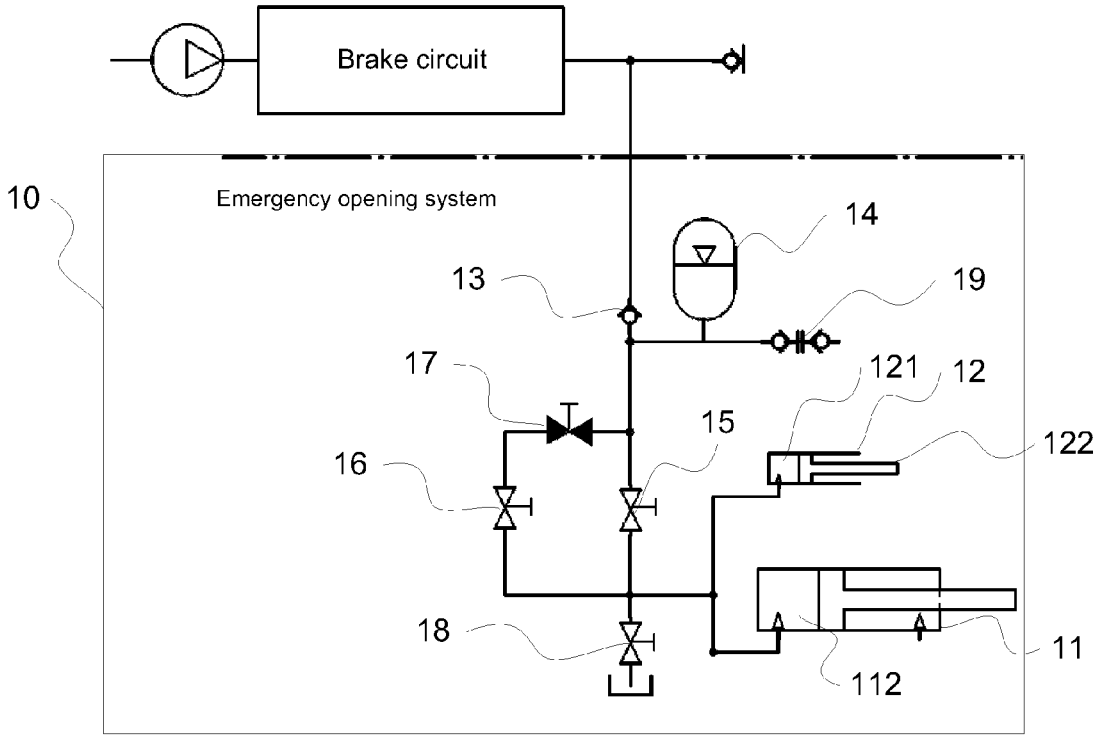
FIG. 1 is a schematic diagram of an emergency opening system according to an embodiment.

In an embodiment, according to FIG. 1, a system 10 for emergency opening of a door or window 24 is provided. The system 10 comprises a first opening mechanism 11 which acts to force the door and/or window 24 to open by means of hydraulic pressure.

Figure 2:
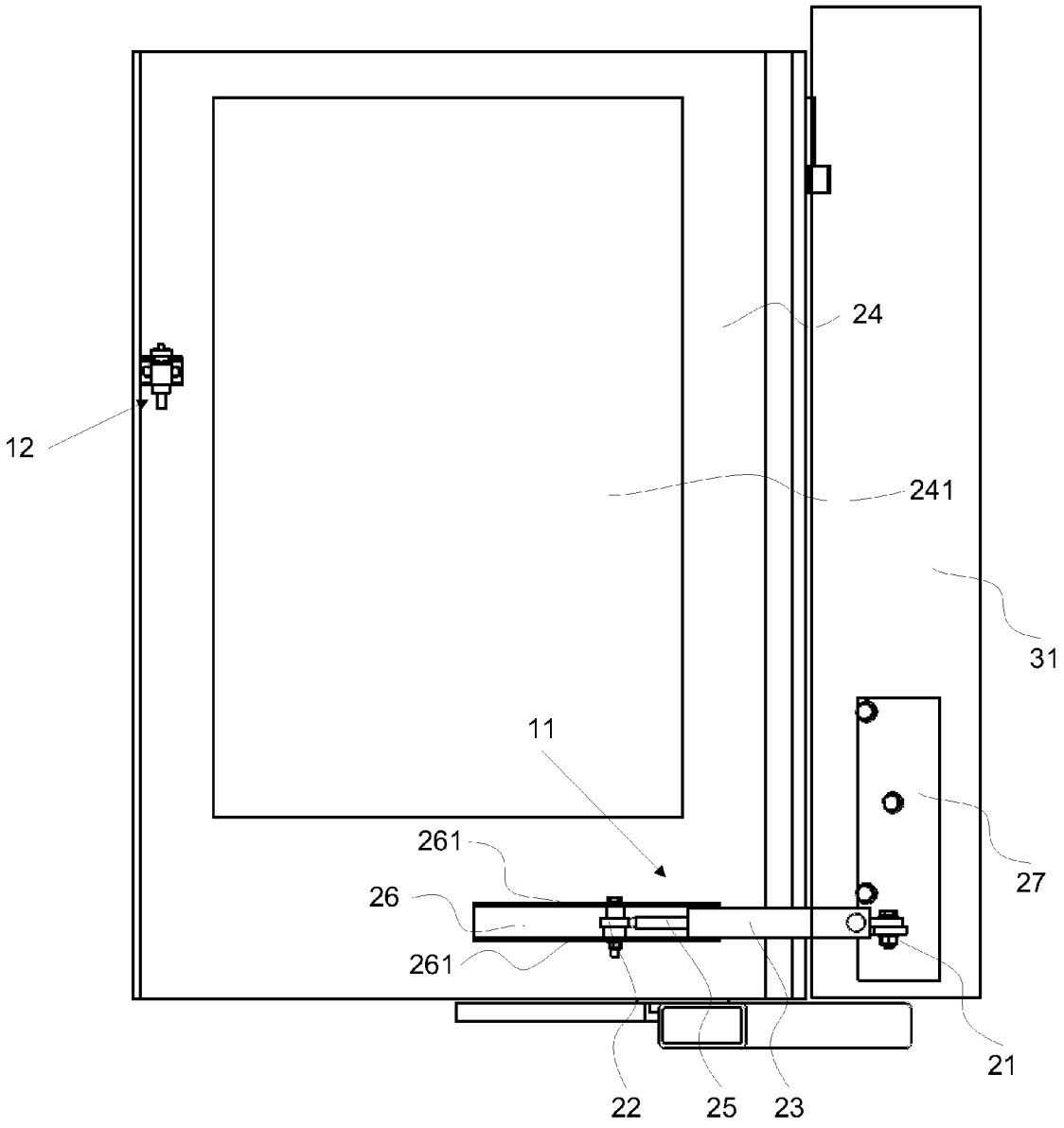
FIG. 2 is a schematic illustration of a window equipped with a first opening mechanism and a first unlocking mechanism of the system according to an embodiment.
Figure 12A:
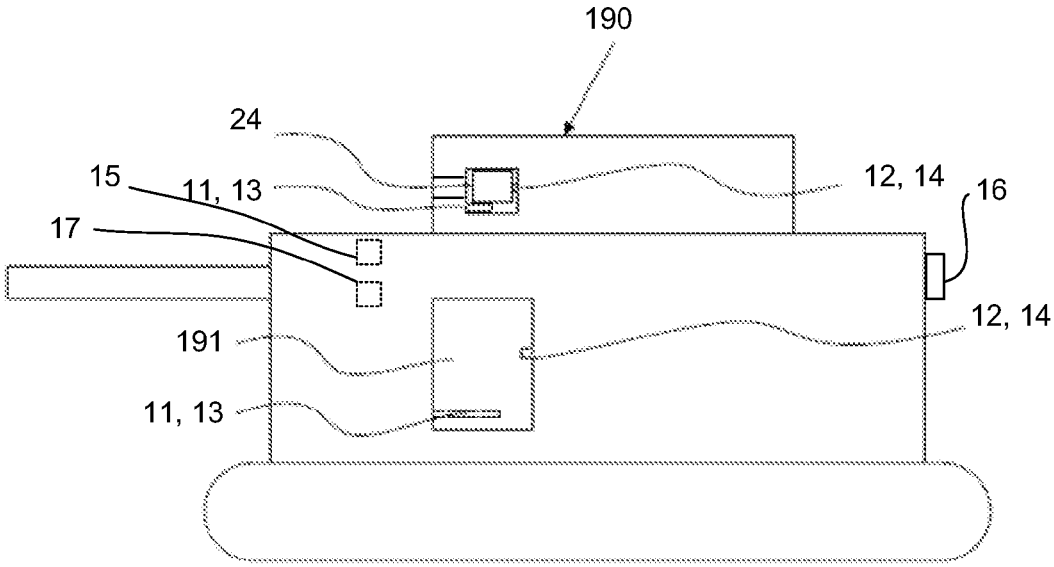
FIGS. 12*a* and 12*b*, respectively, illustrates vehicles wherein the emergency opening system is incorporated according to an embodiment.
Figure 12B:
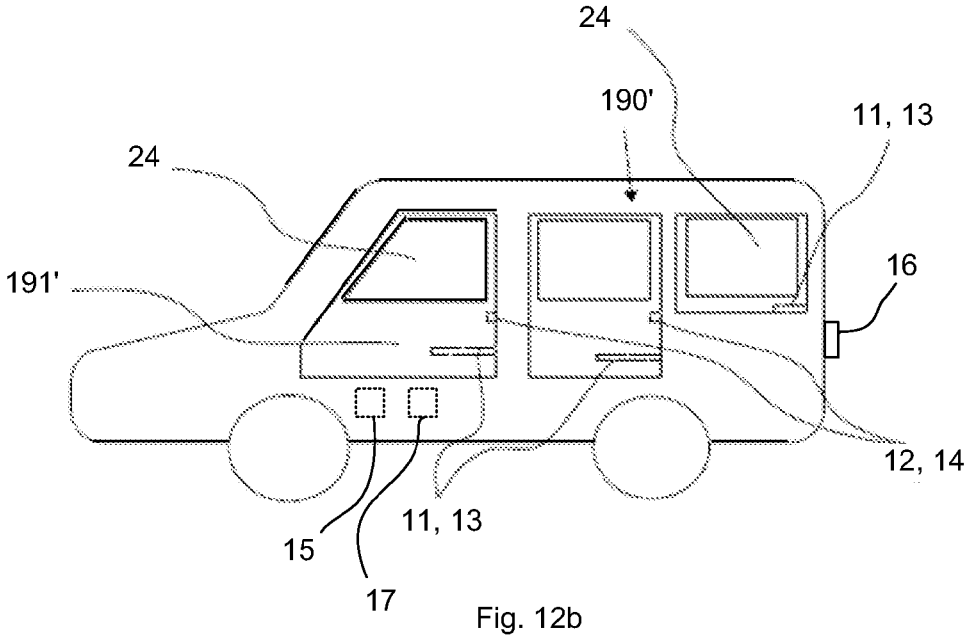

FIG. 2 illustrates the first opening mechanism 11 and a first unlocking mechanism 12 mounted to a window 24 of a vehicle 190, such as an armored vehicle as shown in FIG. 12*a* or an ordinary vehicle 190' as shown in FIG. 12*b*. The first opening mechanism 11 may be mounted on different locations on the window 24, depending on the type of window, the space available inside the vehicle 190, the desired position, etc. In FIG. 2 the first opening mechanism 11 is mounted in the lower part of the window 24, such that it is not visible from the outside through the window pane 241.

As is indicated in FIG. 2, the first opening mechanism 11 comprises a first mounting means 21 which is mounted to a fastening plate 27 which is mounted to a cabin post 31 of a vehicle 190. The first opening mechanism 11 further comprises a second mounting means 22 which is mounted to a U-shaped rail 26 which is mounted to the window 24 of the vehicle 190. The rail 26 comprises an upper portion 261 and a lower portion 262 protruding from the window 24. The upper portion 261 and lower portion 262 are both provided with an elongated slot 263 extending along a part of the upper portion 261 and the lower portion 262. The elongated slot 263 functions as to enable the second mounting means 22 to slide along the elongated opening 263 when the window 24 is opened in an ordinary manner.

Figure 3:
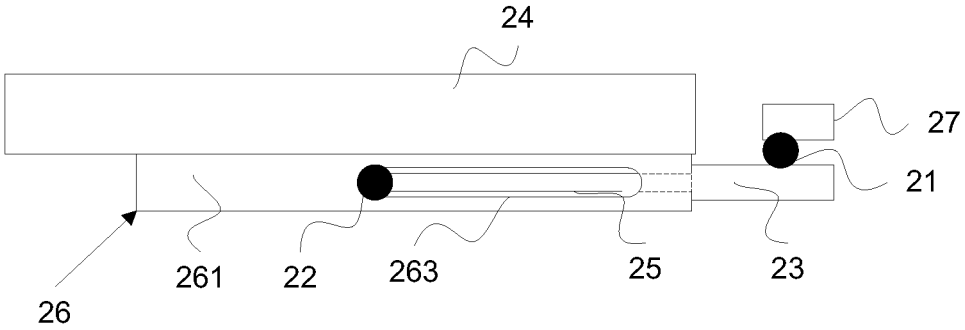
FIG. 3 is a top view of the first opening mechanism mounted to the window by means of a rail according to an embodiment.

FIG. 3 illustrates the rail 26 seen from a top view when the window 24 is in a closed position. In this position the second mounting means 22 is located at the end of the elongated slot 263, i.e. the left end of the slot 263 in FIG. 3. In the event that the window 24 is opened in an ordinary manner, i.e. without emergency opening, the second mounting means 22 will slide along the elongated slot 263 towards the other end of the slot 263, i.e. the right end of the slot 263 in FIG. 3. In this way the first opening mechanism 11 does not interfere with the ordinary opening and closing functionality of the window 24. However, in the event of emergency, due to fact that the second mounting means 22 is located at the end of the elongated slot 263 in the closed position of the window 24, the window 24 will be forced open by means of a hydraulic cylinder 23 and a hydraulic piston 25 which applies an extensive force on the second mounting means 22, and thereby also on the rail 26. Since the second mounting means 22 is blocked from further sliding along the elongated slot 263 in the rail 26 the window 24 will be forced to open, due to the fact that the rail 26 is mounted to the window 24.

The second mounting means 22 is connected to the first mounting means 21 through the hydraulic cylinder 23. The first mounting means 21 serves as a hinge towards the fastening plate 27, and since the fastening plate 27 is mounted to the cabin post 31, the first mounting means 21 also serves as a hinge between the hydraulic cylinder 23 and the cabin post 31. The hydraulic cylinder 23 comprises an inlet (not shown) for receiving a pressurized hydraulic fluid into a cavity therein. When hydraulic fluid enters the cavity of the hydraulic cylinder 23, the piston 25 of the same is forced forward, thereby extending the length of the hydraulic cylinder 23. The piston 25 of the hydraulic cylinder 23 is connected to the second mounting means 22. Thereby, when the hydraulic fluid enters the inlet of the hydraulic cylinder 23 the piston 25 applies a pressure on the second mounting means 22, and thereby also on the window 24, to which the second mounting means 22 is attached.

Figure 4:
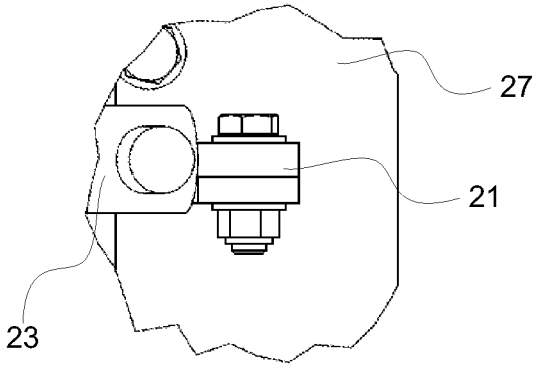
FIG. 4 is a schematic illustration of a first mounting means of the first opening mechanism according to an embodiment.

FIG. 4 illustrates the attachment of the first mounting means 21 to the fastening plate 27 according to an embodiment. In this way the first mounting means 21 serves as a hinge between the cabin post 31 and the hydraulic cylinder 23.

Figure 5:
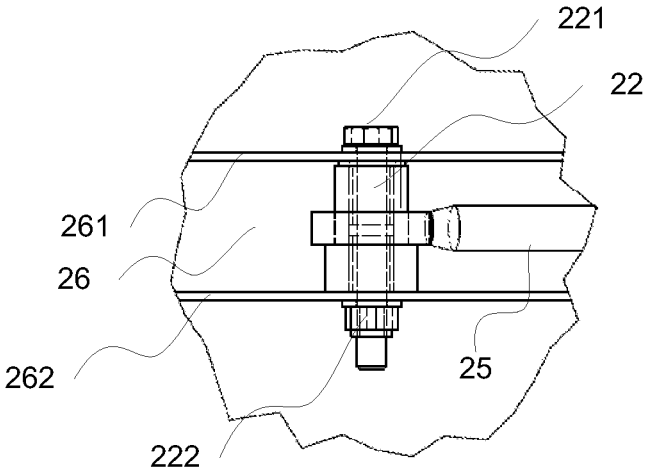
FIG. 5 is a schematic illustration of a second mounting means of the first opening mechanism according to an embodiment.

FIG. 5 illustrates the attachment of the second mounting means 22 to the rail 26 according to an embodiment. The piston 25 is locked to the second mounting means 22 by means of a screw 221 which is locked by a threaded nut 222. The end of the piston 25 is formed as a plate with a hole through which the screw 221 may extend, thus locking the piston 25 to the mounting means 22. It should be appreciated that the mounting means 22 is slidably arranged along the elongated slot 263 provided in the rail 26, so that ordinary opening and closing of the window 24 or door is possible.

Moreover, the emergency system 10 may comprise a first unlocking mechanism 12 for unlocking a lock 41, such as ball lock, provided in the door and/or window 24. The unlocking mechanism 12 is design based on the structure of the lock 41 already provided in the door and/or window 24 of the vehicle 190.

Figure 6:
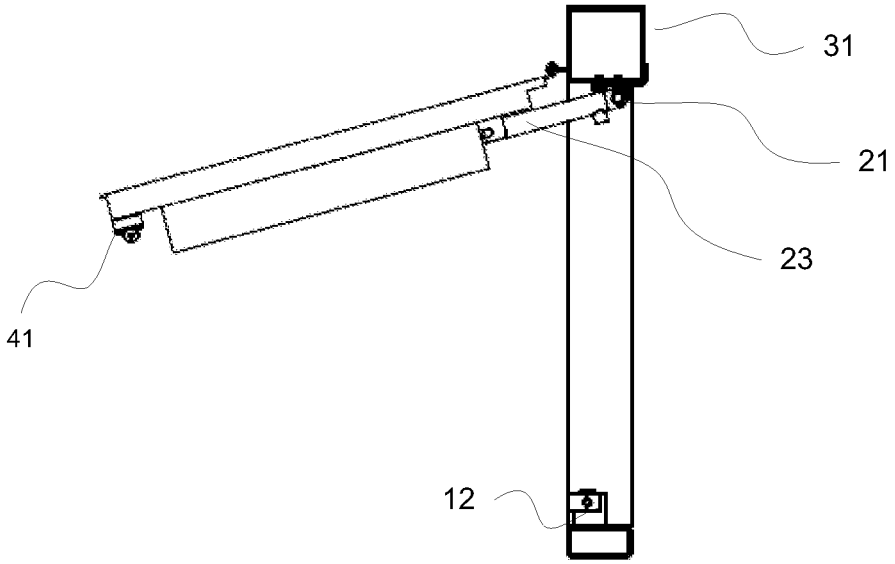
FIG. 6 is a top view of FIG. 2, when the window is in an open position.

FIG. 6 is a top view of FIG. 2 when the window 24 is opened utilizing the first unlocking mechanism 12 and the first opening mechanism 11. The hinge functionality of the first mounting means 21 is clearly understood from FIG. 6. In FIG. 6 the lock already provided in the window 24 of the vehicle 190 is a ball lock 41.

Figure 7:
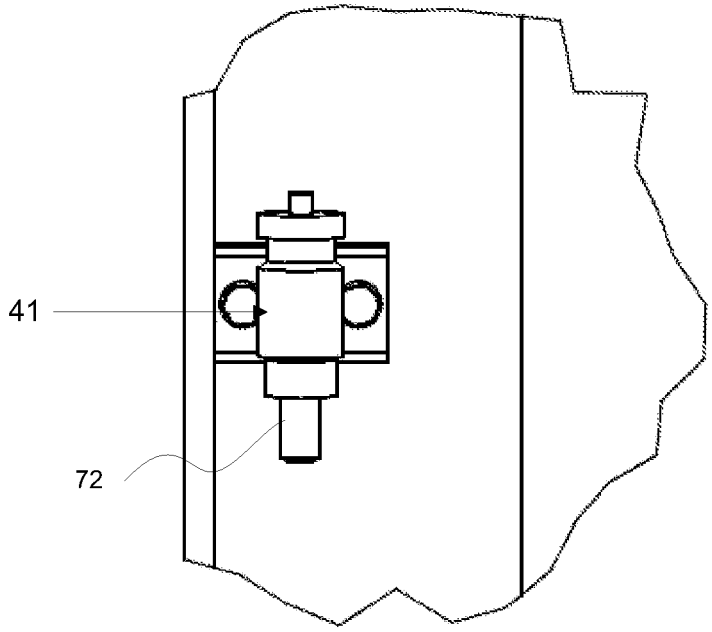
FIG. 7 is a schematic illustration of a ball lock provided on a window or door according to an embodiment.

FIG. 7 illustrates the ball lock 41 of a window according to an embodiment, whereby the first unlocking means 12 when engaged and activated is configured to unlock the ball lock 41.

Figure 8A:
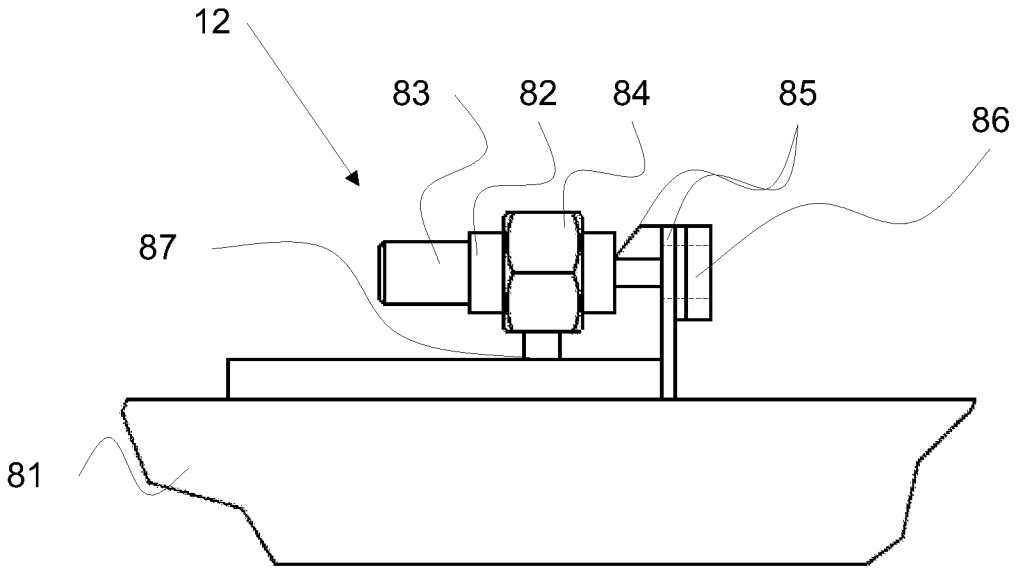
FIGS. 8*a* and 8*b* illustrate a first unlocking means according to an embodiment from different viewing angles.
Figure 8B:
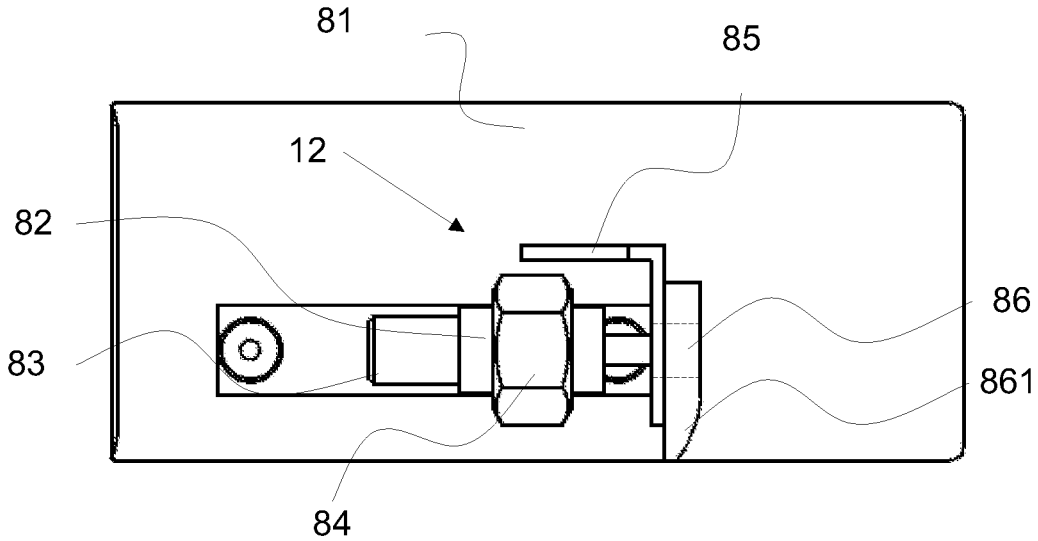

FIG. 8*a* is a side view of the first unlocking means 12 and FIG. 8*b* is a top view of FIG. 8*a*. The first unlocking means 12 is attached to the cabin post 81 of the vehicle 190, and aligned with the lock 41, such as ball lock, provided in the window 24. When the window 24 is closed the first unlocking mechanism 12 is engaged with the ball lock 41. The first unlocking mechanism 12 may e.g. comprise a hydraulic cylinder 82, such as a gas spring, configured to exert a mechanical force onto the locking mechanism of the ball lock 41, thereby unlocking the lock 41, when a hydraulic fluid is introduced into the first unlocking mechanism 12 through an inlet (not shown) provided thereon. Thus, the hydraulic cylinder 82 of the first unlocking mechanism 12 may work in a similar way as the hydraulic cylinder 25 of the first opening mechanism 11. The first unlocking mechanism 12 is so configured that it exerts a force onto the locking mechanism of the lock 41 by means of a piston 83, provided in the hydraulic cylinder 12. This embodiment is advantageous when the lock is a ball lock 41 having a corresponding piston 72, as indicated in FIG. 7, which may be pushed by the piston 83 of the unlocking mechanism 12 from a closed position to an open position, thereby unlocking the lock 41.

The first unlocking mechanism 12 may further comprise an L-shaped plate 85 at least partly covering the hydraulic cylinder 82, and acting to enable locking of the ball lock 41 on the window 24 onto the cabin post 81. Moreover, the first unlocking mechanism 12 comprises an entering plate 86. Both the L-shaped plate and the entering plate 86 are provided with a hole, as is indicated by the dashed lines in FIGS. 8*a*, and 8*b*, suitable for receiving the piston 72 of the ball lock 41. Moreover, the entering plate 86 has a sloped surface 861 onto which the piston 72 of the ball lock 41 may slide when becoming engaged with the first unlocking mechanism 12 during closing of the window 24. In this way the piston 72 of the ball lock 41 is forced onto the entering plate 86 by means of the sloped surface 861, and finally the piston 72 snaps into the hole provided through the L-shaped plate and entering plate 86, and locks the window to the cabin post by means of the piston 72 engaged with the L-shaped plate 85.

With reference to FIG. 8*a*, the lock 41 of the window 24 will thus engage with the first unlocking mechanism 12 in a plane parallel to the side view, and in FIG. 8*b* the lock 41 will engage with the first unlocking mechanism 12 from below towards the sloped surface 861 of the entering plate 86.

The hydraulic cylinder 82 accommodating the piston 83 may be incorporated in an adjustment means, such as an adjustment nut 84. By rotating the adjustment nut 84 the piston 83 may be precisely adjusted such that in use the piston 83 of the first unlocking mechanism 12 extend through the hole of the L-shaped plate 85, thereby enabling the piston 72 of the ball lock 41 to be unlocked from the L-shaped plate 85. Accordingly, when the first unlocking mechanism 12 is activated, the piston 83 of the first unlocking mechanism 12 will push the piston 72 of the ball lock 41 such that it becomes free from the L-shaped plate 85, and thus the window 24 is unlocked.

The adjustment nut 84 may be attached to the cabin post 81 by any suitable fastening means 87.

In an embodiment the emergency opening system 10 is connected to the hydraulic brake system of a vehicle 190 by means of a conduit system. The emergency opening system is configured such that the pressure applied from the brake system is suitable for emergency opening of a door and/or window 24. The energy (force times distance) required for enabling emergency opening of the door and/or window of the system is dependent on the cylinder area of the first unlocking mechanism 12 and first opening mechanism, the momentum lever of the first unlocking mechanism 12 and first opening mechanism, and the accessible pressure from the brake system of the vehicle 190. Hence, by changing the cylinder area(s) and momentum lever(s), taking into account the accessible pressure from the brake system, the emergency opening system may be adapted for each vehicle 190.

The conduit system comprises a one-way valve 97 enabling hydraulic fluid, e.g. having a pressure of 120-140 bar (12-14 MPa), from the brake system of the vehicle 190 to enter the emergency opening system. An accumulator 96 is connected in parallel with the one-way valve 97. The functionality of the accumulator 96 is to calibrate the level of hydraulic fluid in the conduit system. In use, the one-way valve 97 serves to enable hydraulic fluid from the brake system of the vehicle 190 into the emergency opening system. Once the hydraulic fluid has entered the emergency opening system via the one-way vale 97, it is prevented by the one-way valve 97 to flow back into the brake system of the vehicle 190. By means of the one-way valve 97 and the hydraulic fluid from the brake system, the emergency opening system 10 is completely charged with hydraulic fluid very rapidly, e.g. in the order of seconds, such as 5 to 15 seconds. Furthermore, once the emergency opening system has been charged with hydraulic fluid from the brake system of the vehicle 190, it will remain fully charged over time until an emergency opening is activated, by means of the one-way valve 97. This is advantageous since the emergency opening system thus only requires to be charged at one instance for each emergency opening. Once charged no further hydraulic fluid will enter through the one-way valve 97, and thus the brake system of the vehicle 190 will function as if no emergency opening system was connected to the brake system after charging of the emergency opening system.

The system may further be provided with a first opening valve 15 which is physically located on the inside of the vehicle 190, such that it may be reached by a person trapped inside the vehicle 190. The first opening valve 15 is normally set to a closed position. In its closed position no hydraulic fluid can pass through the first opening valve 15 to the first opening mechanism 11 and the first unlocking mechanism 12. However, when the first opening valve 15 is set to its open position hydraulic fluid can pass through the first opening valve 15 and further on to the first opening mechanism 11 and the first unlocking mechanism 12, thereby activating the emergency opening of the door and/or window.

The first opening valve 15 may e.g. be a ball valve whose open or closed position may be set mechanically by a person located inside the vehicle 190.

The system may further comprise a second opening valve 16 which is located on the outside of the vehicle 190, and is used for enabling a person on the outside of the vehicle 190 to open the door and/or window of a vehicle 190 in the case of an emergency.

The first opening valve 15 and the second opening valve 16 may be connected in parallel. In this way the second opening valve 16 may be activated from outside the vehicle 190 in case the conduit system close to the first opening valve 15 has been blocked when the vehicle 190 has been demolished.

In an embodiment, the second opening valve 16 is provided on the outside of the vehicle 190 in a hidden position, such as to avoid unauthorized persons to find the second opening valve 16. The second opening valve 16 has the same functionality as the first opening valve 15, i.e. when in its closed position it hinders hydraulic fluid to pass there through onto the first opening mechanism 11 and the first unlocking mechanism 12. In its open position hydraulic fluid can flow through the second opening valve 16, thereby enabling activation of the first opening mechanism 11 and first unlocking mechanism 12.

The system may further comprise a blocking valve 17, connected in series between the one-way valve 93 and the second opening valve 16. The blocking valve 17 may be provided on the inside of the vehicle 190. Preferably, the blocking valve 17 has the same functionality as the first and second opening valves 15, 16, i.e. when set to its open position hydraulic fluid is allowed to pass there through, and when set to its closed position no hydraulic fluid is allowed to pass there through. The blocking valve 17 enables the driver or personnel of the vehicle 190 to disable emergency opening of the door and/or window with the second opening device 16. Hence, when the blocking valve 17 is closed no hydraulic fluid is let through to the second opening valve 16. In such a case it does not matter whether the second opening valve 16 is opened or closed, since no hydraulic fluid is available to activate the first opening mechanism 11 and first unlocking mechanism 12.

It is advantageous in some situations to enable the driver or personnel of the vehicle 190 to disable the opening of the door and/or window from the outside. Such a situation is when the vehicle 190 is driving through an angry mob which potentially could find the second opening valve and try to open the door and/or window. However, the blockage valve 17 is preferably normally open in order to allow persons from outside the vehicle 190 to assist in opening the door and/or window of the vehicle 190, in case of emergency for the personnel inside the vehicle 190.

Light Source on Instrument Panel

In an embodiment, a light source (not shown) is provided in the vehicle 190, such as on the instrument panel, to indicate to the driver or personnel when the blocking valve 17 is in its closed position. For example, the light source may be connected to the blocking valve 17 by means of a wire (not shown) having a contact located at a position at which a corresponding contact of the blocking valve 17 is located when the blocking valve 17 is in its closed position. The contact of the blocking valve 17 may be grounded and the light source may be subject to a voltage, by means of an electrical power source. When the blocking valve 17 is in its open position, the contact of the wire and the contact of the blocking valve 17 are not in contact, whereby the electrical circuit is open and no current may flow through the light source. However, when the blocking valve 17 is set to its closed position, the two contacts are interconnected, resulting in that a current may flow through the light source, whereby the light source starts to emit light. In another embodiment, the system may be correspondingly reversed, such that the light source emits light when the blocking valve 17 is in an open position.

In another embodiment, the light source is connected to a sensor via a processor (not shown). The sensor is configured to detect when the blockage valve is in its closed position, and send an output signal based on the detection to a processor. The processor may control the light source to emit light based upon the received output signal.

In the same way, the valves 97, 15, 16, 18 may be provided with corresponding light sources, such that the instrument panel may visualize if these valves are open or closed.

Emptying the System

Figure 9:
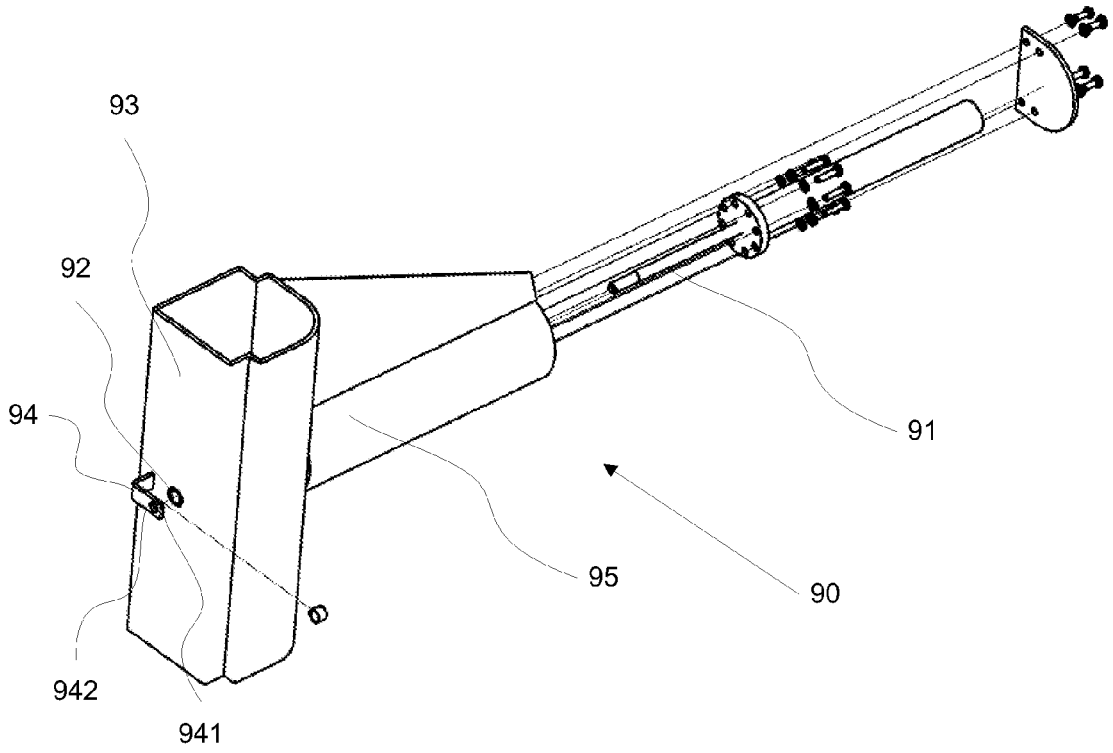
FIG. 9 is an exploded view of a second opening mechanism of the system for connection through a cabin post of a vehicle.

In an embodiment, shown in FIG. 1 and FIG. 9, the emergency opening system further comprises a restoration valve 18. When the restoration valve 18 is in its open position, it is configured to enable emptying the conduit system from hydraulic fluid. The restoration valve 18 is connected after and in parallel with the first 15 and second opening valves 16 in the conduit system. The restoration valve 18 is normally closed, whereby hydraulic fluid is not allowed to pass there through to a drain. In its closed position, hydraulic fluid originating from the first or second opening valves 15 or 16 continues in the conduit system towards the first opening mechanism 11 and the first unlocking mechanism 12.

Door Opening

In an embodiment, according to FIG. 9, a second unlocking mechanism 90 is provided which is suitable for unlocking a heavy door, e.g. provided on a splinter protected or armored vehicle 190. The second unlocking mechanism 90 comprises a spring bolt 91 configured to slidably fit in a channel provided through a cabin post 93 which ends with an aperture 92 at a first side of the cabin post 93. A protective clamp 94 projects from the first side of the cabin post 93. The clamp 94 is L-shaped and extends distally from the cabin post 93 substantially in the normal of the cabinet post surface onto which the clamp 94 is arranged. The L-shape then allows the clamp 94 to extend substantially in parallel to the cabinet post surface onto which the clamp 94 is arranged. The clamp 94 comprises an aperture 942 in the part of the clamp 94 which extends substantially in parallel to the cabinet post surface. The aperture 942 corresponds to the size of the channel and the aperture 92 in the cabin post 93. In use the spring bolt 91, due to its spring force, is forced through the cabin post 93 and exits the cabin post 93 via the aperture 92. The distance, along the normal of the cabinet post surface onto which the clamp 94 is arranged, between said side of the cabin post 93 and the clamp 941 is constructed in such a way that a locking element of a door (not shown) may be fitted into the space between the first side of the cabin post 93 and the lock clamp 941. The locking element of the door is concentrically aligned with the aperture 92 of the cabin post 93 and the aperture 942 of the clamp 94, such that the locking element of the door engages the spring bolt 91, thereby locking the door to the cabin post 93.

The second unlocking mechanism 90 further comprises a hydraulic chamber 95 into which a hydraulic fluid may enter via an inlet (not shown). As stated above, the spring bolt 91 is continuously forced towards the aperture 942 of the clamp 94, by means of its intrinsic spring force. In the normal condition, the spring force is sufficiently set, such that it is possible to open the door by hand from inside the vehicle 190 by retracting the spring bolt 91. However, in the event that the vehicle 190 has been damaged, e.g. due to an explosion of a land mine, constructional damages may lead to that the door is unable to open by hand In such an event, by introducing hydraulic fluid into the hydraulic chamber the spring bolt 91 is forced backwards thereby unlocking the door.

Combination Door and/or Window

Figure 10:
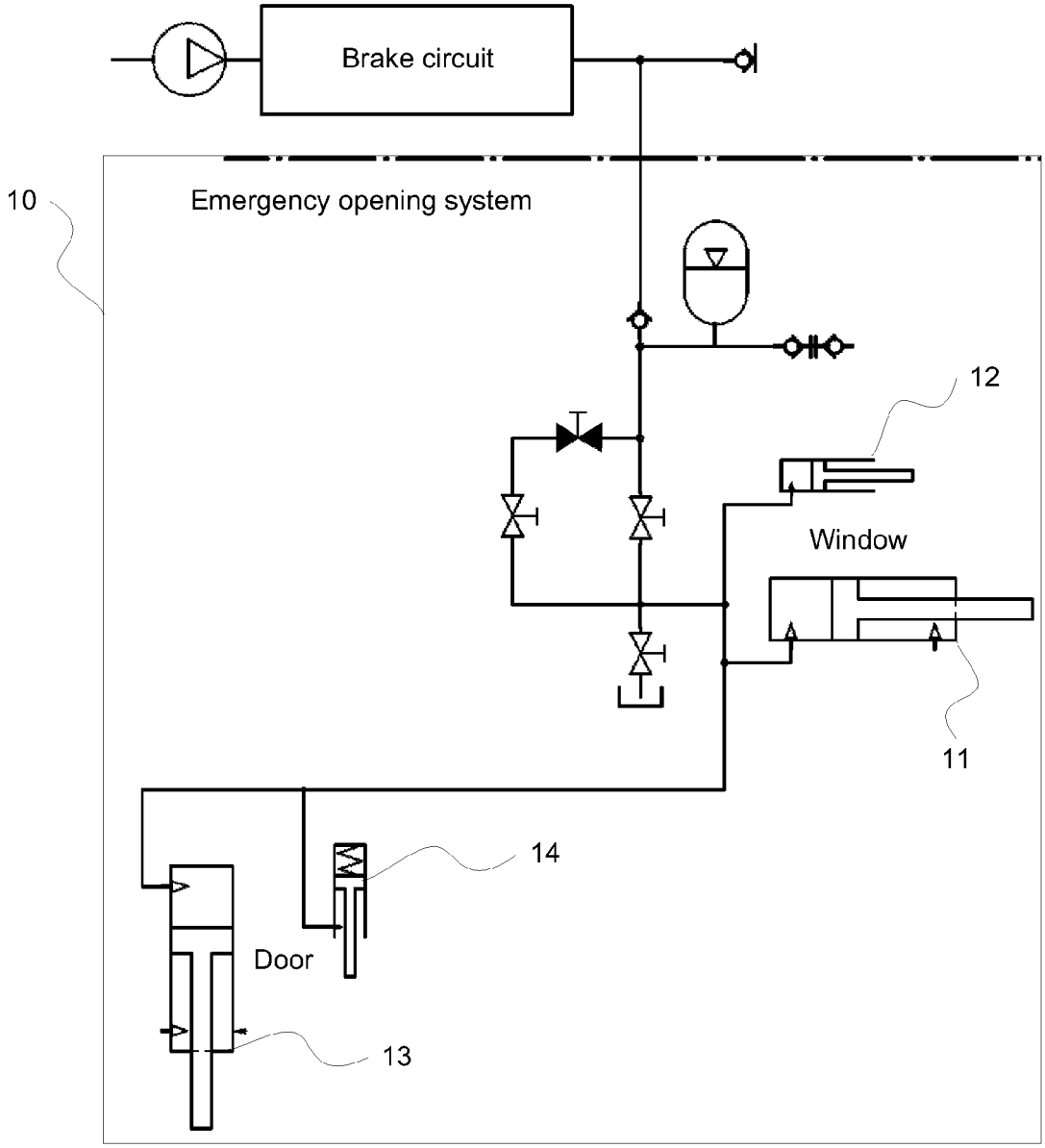
FIG. 10 is a schematic diagram of an emergency opening system according to an alternative embodiment.

In an embodiment according to FIG. 10, the system 10 comprises a first opening mechanism 11 and a first unlocking mechanism 12 provided on a window of a vehicle 190, and a second opening mechanism 13 and a second unlocking mechanism 14 provided on a door of the vehicle 190. The second opening mechanism 13 may be of the same type as the first opening mechanism.

In an alternative embodiment the system 10 only comprises a second opening mechanism 13 and a second unlocking mechanism 14 provided on a door of the vehicle 190.

In one embodiment the first opening mechanism 11 and the first unlocking mechanism 12 are coupled in parallel to the second opening mechanism 13 and the second unlocking mechanism 14. In this way, the probability of one of the door and the window being openable is increased.

In another embodiment the emergency opening system 10 only comprises a first 12 or second 14 unlocking mechanism, and thus not a first 11 or second 13 opening mechanism. In this way, in case of an emergency, it is possible to unlock a jammed door or window which facilitates for subsequent opening of the door or window by hand.

Any combinations of the first opening mechanism, second opening mechanism, first unlocking mechanism, or second unlocking mechanism may be utilized where suitable on a door, latch, window, cover, etc. Hence, the embodiments above referring to either a door or window should only be interpreted for exemplary reasons, since the second unlocking mechanism 14 could also be incorporated in a window or the first unlocking mechanism 12 could be incorporated in a door of a vehicle 190, etc.

The first opening valve, the second opening valve, the blocking valve, and the restoration valve, may be any valve normally used for performing the involved tasks, e.g. a ball valve. The invention is not limited to specific kinds of valves. Any valve being suitable for enabling the involved tasks may be used. Moreover, the invention is not limited to the type of lock provided in the window. It should be appreciated that the first and second unlocking mechanism may be readily adapted to any lock without departing from the gist of the present invention.

Figure 11:
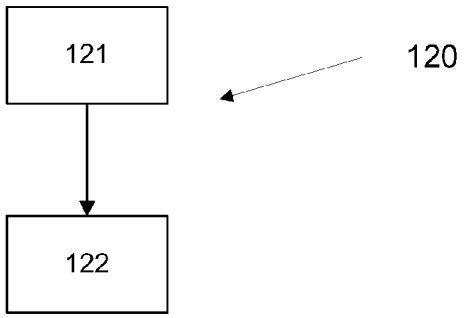
FIG. 11 is a flowchart of a method for restoring the emergency opening system after activation according to an embodiment.

In an embodiment according to FIG. 11, a method 120 for restoring the emergency opening system after activation, i.e. after emergency opening has occurred, is provided. The method comprises setting 121 a restoration valve 18 provided on the inside of the vehicle 190 into its open position, while an opening valve 15 and a blockage valve 17 provided on the inside of the vehicle 190 are closed, to drain the emergency opening system of hydraulic fluid and enabling the hydraulic cylinders of the opening mechanism and unlocking mechanism to be repositioned to their idle positions. Furthermore, the method comprises setting 122 the restoration valve 18 into its closed position to block hydraulic fluid from exiting the emergency opening system.

Described in more detail, the restoration method comprises the following steps:

(1) Open valve 18 and let the activated hydraulic fluid drain so that the system becomes pressure free.

(2) Close valves 15 and 16 which have been used for opening.

(3) Close the open door(s)/window(s) of the vehicle, whereby the opening cylinders resume their emergency positions.

(4) Press back the lock opening cylinders to their respective end positions.

(5) Close valve 18.

(6) Start up the engine of the vehicle and wait until the alert of low brake pressure disappear (which can also be achieved by a device for checking that the pressure of the system has reached the correct level).

(7) Ready—emergency mode restored.

According to an embodiment, the piston 72 may be replaced by a spring bolt 91 or vice versa or any other suitable device for performing the same functionality. Hence, even though some embodiments have been described using the term piston, a spring bolt could optionally be used instead, and vice versa, within the scope of the invention.

Although the present invention has been described above with reference to specific embodiments, it is not intended to be limited to the specific form set forth herein. Rather, the invention is limited only by the appended claims, and further embodiments than the specific above are feasible within the scope of the claims.

The invention claimed is:

1. A system for emergency opening of a vehicle access point of a vehicle, comprising:

an unlocking mechanism configured to open a lock provided on the vehicle access point, the lock comprising a piston locking the lock, wherein the unlocking mechanism comprises a hydraulic unit configured, when activated, to exert a mechanical force onto the piston by introducing a pressure of hydraulic fluid into the hydraulic unit, thereby unlocking the lock;

an opening mechanism with a hydraulic cylinder coupled to a cover positioned over the vehicle access point and the vehicle, the hydraulic cylinder having a first end coupled to the vehicle and a second end coupled to the cover such that upon expansion of the hydraulic cylinder the cover is urged outwardly from the vehicle access point;

a first hydraulic opening valve provided on the inside of the vehicle, wherein the unlocking mechanism is configured to be activated by the first opening valve;

a second hydraulic opening valve provided on the outside of the vehicle, wherein the unlocking mechanism is configured to be activated by the second opening valve; and a hydraulic blocking valve provided on the inside of the vehicle and configured to block the hydraulic fluid flow to the second opening valve, when activated.

2. The system according to claim 1, further comprising an opening mechanism with a hydraulic cylinder configured to open the vehicle access point using pressure of hydraulic fluid, when activated.

3. The system according to claim 2, wherein the opening mechanism comprises a first mounting means for mounting on a cabin post of the vehicle, a second mounting means for mounting on the vehicle access point of the vehicle, wherein the hydraulic cylinder is configured to force the vehicle access point open when a pressure of hydraulic fluid is provided therein.

4. The system according to claim 1, wherein the hydraulic unit is a hydraulic cylinder.

5. The system according to claim 1, wherein the cover defines an elongated slot in which the second end of the hydraulic cylinder and piston assembly is slidably mounted when the vehicle access point is opened or closed.

6. A vehicle comprising an emergency opening system as claimed in claim 1.

7. The vehicle according to claim 6, wherein the vehicle is an armored or splinter protected vehicle.

8. The system according to claim 1, wherein the vehicle access point comprises at least one of a window or a door.

9. The system according to claim 1, wherein the piston comprises a spring bolt.

10. The system according to claim 1, wherein the lock comprises:

an engagement member selectively positionable to in a locking position in which the engagement member prevents opening of the closure member and an open position in which the engagement member does not prevent opening of the closure member;

an urging member positioned to urge the engagement member into the locking position;

wherein the hydraulic unit is configured to urge the engagement member into the open position upon introducing of the pressure of hydraulic fluid.

11. A system for emergency opening of a vehicle access point, comprising:

an unlocking mechanism configured to open a lock provided on the vehicle access point, the lock comprising a piston locking the lock, wherein the unlocking mechanism comprises a hydraulic unit configured, when activated, to exert a mechanical force onto the piston by introducing a pressure of hydraulic fluid into the hydraulic unit, thereby unlocking the lock;

a first opening valve provided on the inside of the vehicle, wherein the unlocking mechanism is configured to be activated by the first opening valve;

a second opening valve provided on the outside of the vehicle, wherein the unlocking mechanism is configured to be activated by the second opening valve; and a blocking valve provided on the inside of the vehicle and configured to block the hydraulic fluid flow to the second opening valve, when activated;

wherein the system is connected to the brake system of the vehicle by means of a conduit system, wherein the pressure of hydraulic fluid originates from the brake system.

12. A system for emergency opening of a vehicle access point of a vehicle, comprising:

an unlocking mechanism operably coupled to a lock provided on the vehicle access point, the lock comprising a piston having a locked state and an unlocked state, wherein the unlocking mechanism comprises a hydraulic unit engaging the lock and positioned such that hydraulic pressure in the hydraulic unit urges the lock from the locked state to the unlocked state;

an opening mechanism with a hydraulic cylinder and piston assembly coupled to a cover positioned over the vehicle access point and the vehicle, the hydraulic cylinder and piston assembly having a first end coupled to the vehicle and a second end coupled to the cover such that upon expansion of the hydraulic cylinder and piston assembly the cover is urged outwardly from the vehicle access point;

a first hydraulic opening valve provided on the inside of the vehicle and coupled to the unlocking mechanism, wherein the first hydraulic opening valve has a first open state in which the first hydraulic opening valve couples a hydraulic pressure source to the hydraulic unit of the unlocking mechanism and a first closed state in which the first hydraulic opening valve does not couple the hydraulic pressure source to the hydraulic unit of the unlocking mechanism;

a second hydraulic opening valve mounted to the outside of the vehicle and coupled to the unlocking mechanism, wherein the second hydraulic opening valve second a first open state in which the second hydraulic opening valve couples a hydraulic pressure source to the hydraulic unit of the unlocking mechanism and a second closed state in which the second hydraulic opening valve does not couple the hydraulic pressure source to the hydraulic unit of the unlocking mechanism; and a hydraulic blocking valve provided on the inside of the vehicle and positioned within a hydraulic flow path between the hydraulic pressure source and the second hydraulic opening and not positioned within a hydraulic flow path between the hydraulic pressure source and the first hydraulic opening valve, the hydraulic blocking valve having an open state in which the hydraulic blocking valve couples the hydraulic pressure source to the second hydraulic opening valve and a closed state in which the hydraulic blocking valve couples the hydraulic pressure source to the second hydraulic valve.

13. The system of claim 12, wherein a pair of slots are defined on the cover and the second end is slideably mounted within the slots, the slots sized and positioned such that the first end slides from first ends of the slots toward second ends of the slots when the cover is moved from a closed position to an open position and wherein the slots are sized and positioned such that the second end engages first ends of the slots upon expansion of the cylinder and piston assembly effective to urge the cover toward the open position.

* * * * *